US009397426B2

(12) United States Patent
Li et al.

(10) Patent No.: US 9,397,426 B2
(45) Date of Patent: Jul. 19, 2016

(54) ELECTRICAL CONNECTOR HAVING A HOUSING WITH A HOLE EXTENDING IN TWO PERPENDICULAR DIRECTIONS

(71) Applicant: FOXCONN INTERCONNECT TECHNOLOGY LIMITED, Grand Cayman (KY)

(72) Inventors: Zhuang-Xing Li, Kunshan (CN); Qin Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/802,237

(22) Filed: Jul. 17, 2015

(65) Prior Publication Data

US 2016/0020539 A1 Jan. 21, 2016

(30) Foreign Application Priority Data

Jul. 17, 2014 (CN) ..... 2014 2 0395411 U

(51) Int. Cl.
*H01R 13/62* (2006.01)
*H01R 12/72* (2011.01)
*H01R 12/70* (2011.01)

(52) U.S. Cl.
CPC ..... *H01R 12/721* (2013.01); *H01R 12/707* (2013.01); *H01R 13/62* (2013.01)

(58) Field of Classification Search
CPC ..... H01R 4/02; H01R 12/72; H01R 12/721; H01R 13/62; H01R 13/627
USPC ..... 439/152–160, 325, 327, 345, 352
See application file for complete search history.

(56) References Cited

U.S. PATENT DOCUMENTS 7,338,303 B1 * 3/2008 Yi ..... H01R 12/87 439/267
7,371,097 B1 * 5/2008 Pennypacker ..... H01R 13/6275 439/327
7,658,628 B2 * 2/2010 Guan ..... H01R 13/6273 439/157
7,666,011 B2 * 2/2010 Lim ..... H05K 7/1405 439/157
7,938,658 B1 * 5/2011 Zeng ..... H01R 12/7029 439/160
8,070,499 B2 * 12/2011 Guan ..... H01R 12/7029 439/155
2006/0089108 A1 * 4/2006 Lagnado ..... H01Q 1/22 455/90.3
2010/0062648 A1 * 3/2010 Guan ..... H01R 12/721 439/630
2010/0317234 A1 * 12/2010 Yao ..... H01R 12/721 439/637
2011/0104926 A1 * 5/2011 Li ..... H01R 12/737 439/327
2011/0159718 A1 * 6/2011 McKee ..... H01R 12/721 439/326
2013/0252449 A1 * 9/2013 Tang ..... H01R 12/721 439/325

FOREIGN PATENT DOCUMENTS

CN 201438529 U 4/2010

* cited by examiner

*Primary Examiner* — Chandrika Prasad
(74) *Attorney, Agent, or Firm* — Wei Te Chung; Ming Chieh Chang

(57) ABSTRACT

An electrical connector includes an insulative housing and a plurality of contacts received in the housing. At least a retainer is retained in the insulative housing. The retainer includes a soldering portion leaning on a bottom side of the housing and said housing defines a hole corresponding to said soldering portion. The hole communicates with exterior in both a lengthwise direction and an inserting direction which is perpendicular to the lengthwise direction for enhancing the stability of welding.

17 Claims, 5 Drawing Sheets

ELECTRICAL CONNECTOR HAVING A HOUSING WITH A HOLE EXTENDING IN TWO PERPENDICULAR DIRECTIONS

BACKGROUND OF THE INVENTION

1. Field of the Invention

The present invention relates to an electrical connector, more particularly to an electrical connector with a reliable soldering.

2. Description of Related Art

China Patent No. CN201438529U, published on Apr. 14, 2010, discloses a similar electrical connector, and the electrical connector includes an insulative housing, a plurality of contacts retained in the insulative housing, a pair of latches mated in both sides of the insulative housing, and a pair of hooks retained in both sides of the insulative housing. Each of the hooks defines a retaining portion retained in the insulative housing, and a soldering portion bending and extending from the retaining portion for a welding with a mating print circle board. The insulative hosing has a blind hole for receiving the retaining portion. When the hooks is being soldered, the solder is hard to flow in the soldering portion for a limited space, and it could make the solder block in the soldering surface, and the redundant solder could adhere with the insulative housing which could cause a bad welding and a shaking between the electrical connect and the mating print circle board. Further more, the bad welding or shaking makes a bad electrical transmission performance.

Hence, an improved electrical connector is required to overcome the disadvantages of the related art.

BRIEF SUMMARY OF THE INVENTION

Accordingly, the object of the present invention is to provide an electrical connector with a reliable soldering.

In order to achieve the object reminded above, an electrical connector includes an insulative housing and a plurality of contacts received in the housing. At least a retainer is retained in the insulative housing. The retainer includes a soldering portion leaning on a bottom side of the housing and said housing defines a hole corresponding to said soldering portion. The hole is depressed upwardly from said bottom side of the housing, said hole communicates with exterior in both a lengthwise direction and an inserting direction for enhancing the stability of welding.

In order to achieve the object reminded above, another electrical connector is provided and it includes an insulative housing and a plurality of contacts retained in the housing. At least a retainer is retained in the insulative housing. The retainer has a soldering portion extending out of the housing, and said housing defines an L-shaped hole upon said soldering portion. The L-shaped hole passes through both upside of the insulative housing in the up-and-down direction and outside of the insulative housing in the lengthwise direction.

According to the present invention, the electrical connector defining an L-shaped through hole could improve the quality of welding between the retainer and a mating print circle board.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
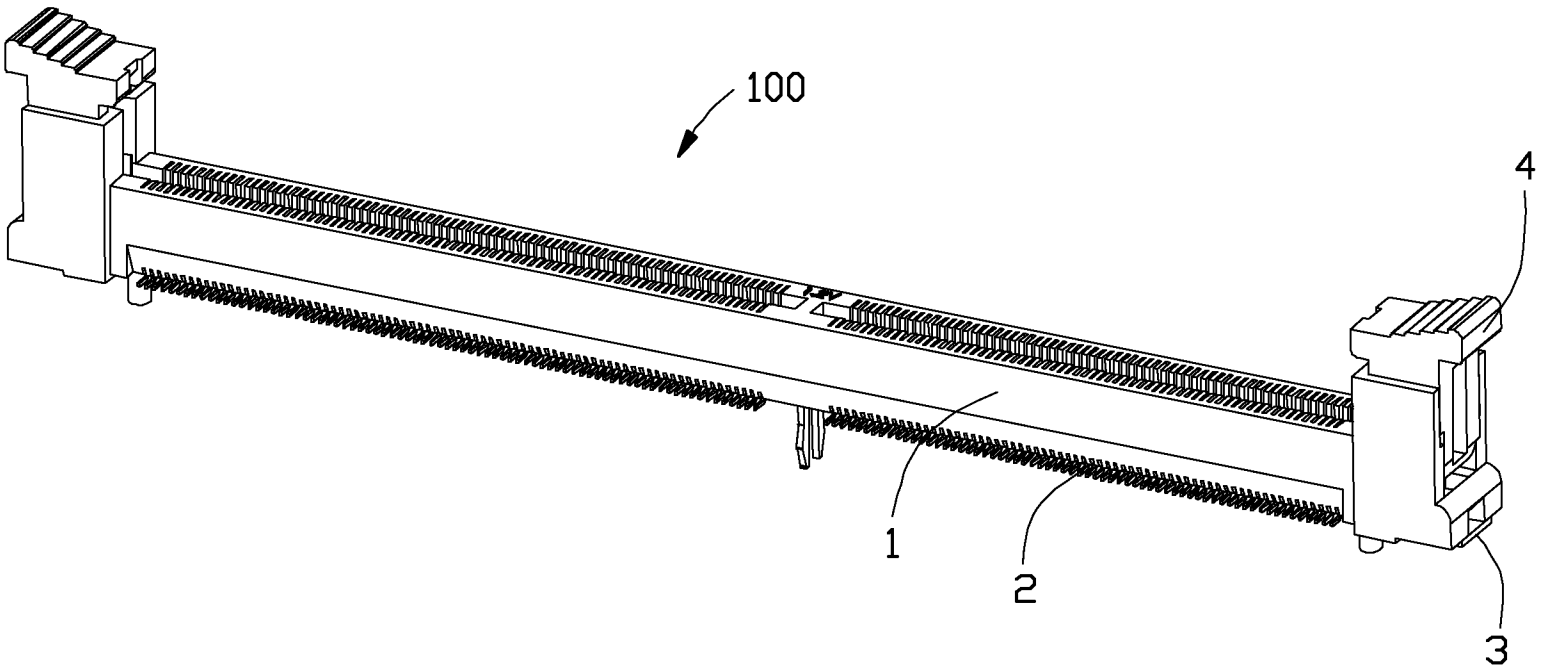
FIG. 1 is a perspective view of an electrical connector according to the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
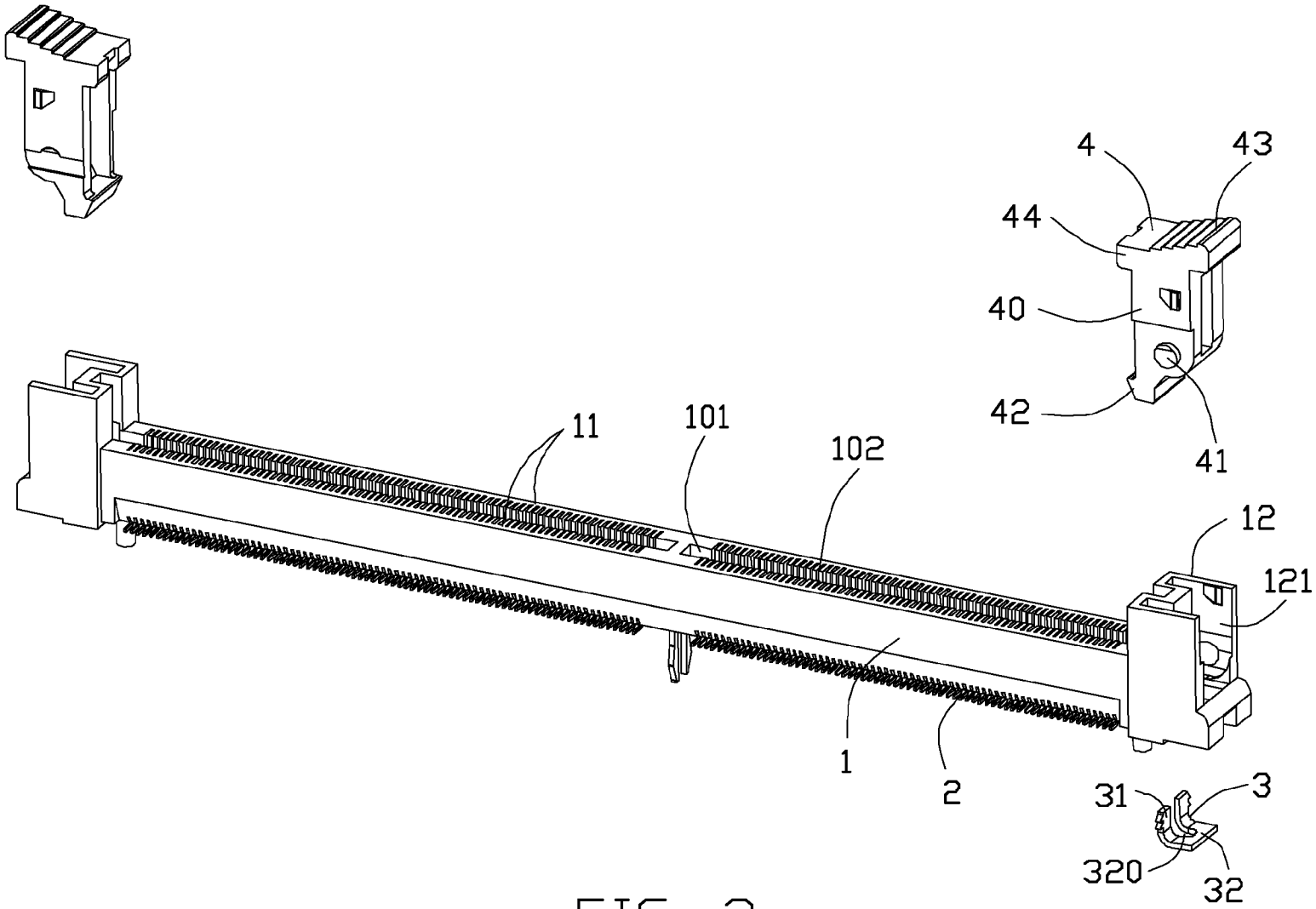
FIG. 2 is an exploded view of the electrical connector shown in FIG. 1.
Figure 3:
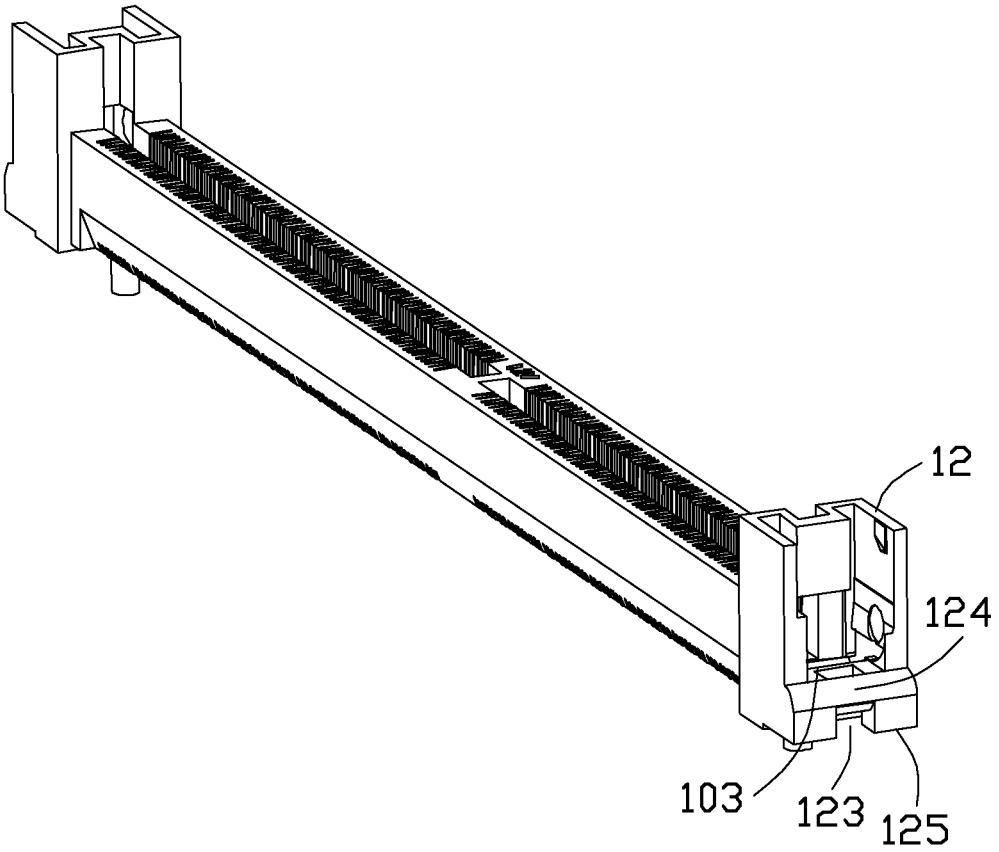
FIG. 3 is a partly perspective view of the electrical connector shown in FIG. 2.
Figure 4:
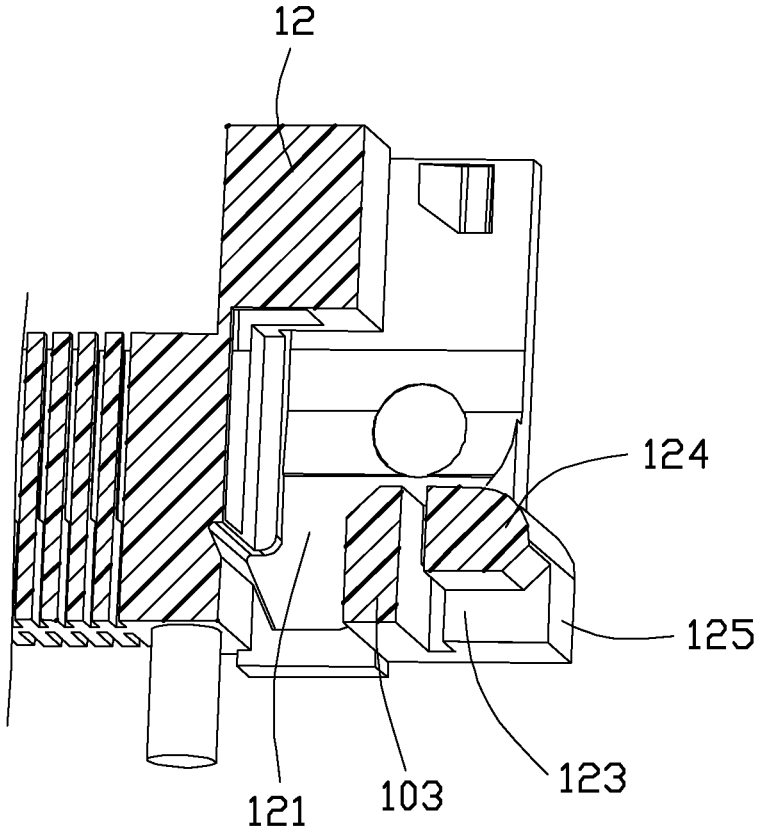
FIG. 4 is a partly cross-sectional view of the object shown in FIG. 3.

According to the present invention, an electrical connector for receiving a mating card (not shown) is provided which could be welded to a print circle board (not shown). Referring to FIGS. 1-2, the present aspect of the invention shows an electrical connector 100 including an insulative hosing 1 and a plurality of contacts 2 received in the housing. At least a retainer is retained in the insulative housing for being welded on the print circle board. A pair of latches 4 is mated on both sides of the insulative housing 1.

Figure 5:
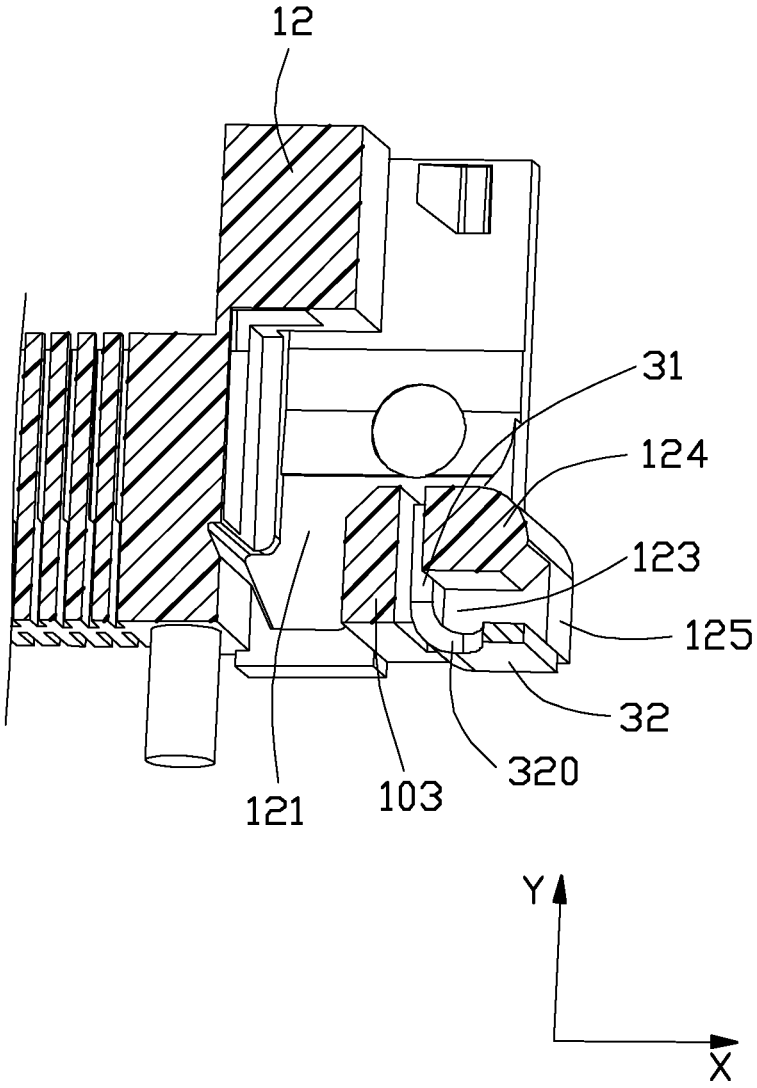
FIG. 5 is a partly cross-sectional view of the object shown in FIG. 3 with a retainer.

The insulative housing 1 includes a pair of longitudinal sidewalls 11 and a pair of end walls or towers 12 connects both ends of the sidewalls 11 in the transverse direction (the X direction in FIG. 5). A central inserting slot 101 is formed in the insulative housing 1 by the sidewalls 11 and the end walls 12 for receiving a mating electrical card (not shown). The insulative housing 1 also defines a plurality of grooves 102 connecting the central insertion slot 101 for receiving the contacts 2. Each of the contacts 2 has a contacting arm (not shown) protruded into the central insertion slot 101, and a soldering portion(not shown) extending downwardly from the contacting arm and out of the insulative housing for an electrical communication with the mating print circle board.

The end walls 12 is tower liked and higher than the sidewalls 11. Each of the end walls 12 has a receiving opening 121 for receiving the latch 4, and the latch 4 could be rotated to switch between an opening position and a locking position relatively to the insulative housing 1. The latch 4 includes a base portion 40, a pair of rotating shafts 41 protruding from both sides of the base portion 40 and pivoting in the end wall 12 of the insulative housing 1, a pushing portion 42 extending towards the central insertion slot 101 from one end of the base portion 40, an operating portion 43 disposed at distal end of the latch 4 and a locking portion 44 disposed at opposite end of the operating portion 43 and extending towards the central insertion slot 101 for locking the mating electrical card. The latch 4 could rotate around the rotating shafts 41, thereby the pushing portion 42 could swing between the receiving opening 121 and the central insertion slot 101 to make a communication between the latch 4 and the mating electrical card.

When the operating portion 43 is turned outwards, the latch 4 is disposed at the opening station, and the mating electrical card (not shown) could be inserted into the central insertion slot 101. While the mating electrical card is inserted into the central insertion slot 101, the mating electrical card pushes the pushing portion 42 and makes the latch 4 rotate into the receiving opening 121. And when the mating electrical card is positioned, the locking portion 44 clasps the mating electrical card. The base portion 40 protrudes an engaging portion (not shown) engaging with the inner face of receiving opening 121 for retaining the latch 4 in the receiving opening 121, meanwhile the latch 4 is disposed at the closing station or locking station.

Referring to FIGS. 1-5, a retainer or solder pad 3 defines a barb structure 31 held in the bottom of the end wall 12. The retainer 3 further has a soldering portion 32 extending and bending from the barb structure 31 and leaning on a bottom side of the insulative housing 1 which makes the retainer 3 form in L-shape. The soldering portion 32 is surface welding without any through hole in the print circle board (not shown). The insulative housing 1 has a through hole 123 corresponding to the retainer 3. The insulative housing 1 defines an inner wall 103 at an inner side of the through hole 123 in the lengthwise direction. The retainer 3 is retained in the through hole 123 and interferes with the inner wall 103. The through hole 123 passes outwardly through the bottom of the end wall 12 of the insulative housing 1 in the lengthwise direction, while the through hole 123 passes through the insulative housing 1 in an inserting direction which is perpendicular to the lengthwise direction. And it simplifies the structure and makes moulds easy to release after molding. The through hole 123 is upon the soldering portion 32, and the soldering portion 32 further defines a passageway 320 corresponding to the through hole 123 for welding. So that, the through hole 123 is benefit for hot air passing through when welding and it improves the quality of climbing tin around the soldering portion 32. And it could avoid the tin from sticking with the insulative housing 1, and further more, it prevents the electrical connector 100 from wrapping by the sticky. In another aspect, the through hole 123 is convenience to observe the circumstance of the welding and could make up the defect exposed in the welding in time, and it could also protect a retaining gap of the insulative housing 1 for the retainer 3 assembled from turning into insufficient caused by shrinking, and that is to say, it is benefit for assembly the retainer 3 into the insulative housing 1.

The insulative housing 1 has an outer wall 124 integrally formed at the outside of the through hole 123 opposite to the inner wall 103 and two bottom walls 125 in both sides of the through hole 123. The outer wall 124 connects the two bottom walls 125 and locates at both outside of the through hole 123 in the lengthwise direction and upside of the through hole 23 in the inserting direction. That is to say, the through hole 123 is formed in L-shaped, and passes outwardly through the end wall 12 in the lengthwise direction and passes upwardly through the end wall 12 in the up-and-down direction. The inner wall 103, the outer wall 124 and the bottom wall 125 make the through hole 123 stable and protect the insulative housing 1 from damage when the retainer 3 is pulled off.

Thus, the electrical connector mentioned by the present invention defining an L-shaped through hole could improve the quality of welding between the retainer and a mating print circle board, and it also could avoid the retainer from being unable to be assembled by a thermal deformation of the through hole.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector including:

an insulative housing;

a plurality of contacts received in the housing;

at least a retainer retained in the insulative housing, and the retainer including a soldering portion leaning on a bottom side of the housing;

wherein said housing defines a hole corresponding to said soldering portion and depressed upwardly from said bottom side of the housing, said hole communicates with exterior in both a lengthwise direction and an inserting direction which is perpendicular to the lengthwise direction.

2. The electrical connector as described in claim 1, wherein the insulative housing has an outer wall integrally formed at outside of the hole.

3. The electrical connector as described in claim 2, wherein the outer wall locates in upside of the hole and outside thereof in the lengthwise so as to make the hole present as an L-shape.

4. The electrical connector as described in claim 1, wherein the retainer defines a barb structure held in the bottom of the insulative housing.

5. The electrical connector as described in claim 4, wherein the soldering portion of the retainer extends and bends outside of the insulative housing.

6. The electrical connector as described in claim 4, wherein the insulative housing defines an inner wall at an inner side of the hole and opposite to the outer wall, wherein the retainer is retained in the hole and interferes with the inner wall.

7. The electrical connector as described in claim 4, wherein the insulative housing defines two side walls extending in the lengthwise direction and two end walls connecting both ends of the two side walls in a width direction which is perpendicular to the lengthwise direction, wherein the hole locates in the bottom of the end wall.

8. An electrical connector, comprising:

an insulative housing;

a plurality of contacts retained in the housing;

at least a retainer retained in the insulative housing and having a soldering portion extending out of the housing;

wherein said housing defines an L-shaped hole upon said soldering portion, and the L-shaped hole passes through both upside of the insulative housing in the up-and-down direction and outside of the insulative housing in the lengthwise direction.

9. The electrical connector as described in claim 8, wherein the insulative housing defines two bottom walls locating at both sides of the hole and an outer wall connecting the two bottom walls.

10. The electrical connector as described in claim 9, wherein the insulative housing defines an inner wall at an inner side of the hole and opposite to the outer wall, wherein the retainer is retained in the hole and interferes with the inner wall.

11. The electrical connector as described in claim 8, wherein the soldering portion of the retainer extends and bends outside of the insulative housing.

12. An electrical connector comprising:

an insulative housing defining a slot extending along a longitudinal direction;

a plurality of contacts disposed in the housing beside said slot in a transverse direction perpendicular to said longitudinal direction;

a pair of towers formed at two opposite longitudinal ends and extending in a vertical direction perpendicular to both said longitudinal direction and said transverse direction; and a metallic retaining solder pad located at one of said towers and including an upper upstanding section upwardly extending into the corresponding tower and a lower horizontal section located below the upper upstanding section and below a bottom face of the corresponding tower so as to be downwardly exposed to an exterior; wherein the corresponding tower forms a hole extending through an end surface of the tower and communicating outwardly with the exterior in said longitudinal direction, and downwardly communicating with the horizontal section of the solder pad in the vertical direction.

13. The electrical connector as claimed in claim 12, wherein the solder pad forms a fork structure around a joint portion between the upper upstanding section and lower horizontal section so as to allow a user to supplement solder material about an interface under the solder pad through said hole from the exterior.

14. The electrical connector as claimed in claim 12, wherein an ejector is pivotally located on the tower and above the solder pad.

15. The electrical connector as claimed in claim 14, wherein said hole further extends, at an inner end thereof, upwardly with an vertical region to communicate upwardly with the ejector.

16. The electrical connector as claimed in claim 15, wherein said vertical region of the hole communicate with the upper upstanding section of the solder pad.

17. The electrical connector as claimed in claim 14, wherein the ejector includes, in the vertical direction, a lower ejector extending into the slot, and an upper handler, and the hole is essentially at the same level with the ejector.

* * * * *